US010248040B2

(12) United States Patent
Asakawa

(10) Patent No.: US 10,248,040 B2
(45) Date of Patent: Apr. 2, 2019

(54) ELECTROSTATIC LATENT IMAGE DEVELOPING CARRIER AND TWO-COMPONENT DEVELOPER

(71) Applicant: KYOCERA Document Solutions Inc., Osaka (JP)

(72) Inventor: Tomoyasu Asakawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/111,630

(22) Filed: Aug. 24, 2018

(65) Prior Publication Data

US 2019/0064689 A1 Feb. 28, 2019

(30) Foreign Application Priority Data

Aug. 30, 2017 (JP) ..... 2017-165335

(51) Int. Cl.

*G03G 9/113* (2006.01)
*G03G 9/087* (2006.01)
*G03G 9/107* (2006.01)

(52) U.S. Cl.

CPC ..... *G03G 9/1134* (2013.01); *G03G 9/08702* (2013.01); *G03G 9/1075* (2013.01); *G03G 9/1131* (2013.01); *G03G 9/1132* (2013.01); *G03G 9/1136* (2013.01); *G03G 9/1138* (2013.01)

(58) Field of Classification Search

CPC .. G03G 9/1134; G03G 9/1136; G03G 9/1138; G03G 9/1132; G03G 9/1075; G03G 9/1131; G03G 9/1133; G03G 9/1135
USPC ..... 430/111.35, 111.32
See application file for complete search history.

(56) References Cited

U.S. PATENT DOCUMENTS

2009/0170022 A1* 7/2009 Kojima ..... G03G 9/1134 430/111.1
2018/0329331 A1* 11/2018 Kurano ..... G03G 9/1134

FOREIGN PATENT DOCUMENTS

JP 2002-148869 A 5/2002

* cited by examiner

*Primary Examiner* — Janis L Dote
(74) *Attorney, Agent, or Firm* — Studebaker & Brackett PC

(57) ABSTRACT

An electrostatic latent image developing carrier includes carrier particles each including a carrier core and first and second coat layers covering a surface of the carrier core. The first and second coat layers give a layered structure in which the first coat layer and the second coat layer are layered in order from the surface of the carrier core. The first coat layer contains a fluororesin. The second coat layer contains a silicone resin and a fluorine silane in an amount of at least 1% by mass relative to a mass of the silicone resin. An area $S_A$ of a region of a surface region of the first coat layer that is covered with the second coat layer and an area $S_B$ of a region thereof that is not covered with the second coat layer satisfy a relationship represented by "$0.05 \leq S_B/(S_A+S_B) \leq 0.50$".

9 Claims, 2 Drawing Sheets

ELECTROSTATIC LATENT IMAGE DEVELOPING CARRIER AND TWO-COMPONENT DEVELOPER

INCORPORATION BY REFERENCE

The present application claims priority under 35 U.S.C. § 119 to Japanese Patent Application No. 2017-165335, filed on Aug. 30, 2017. The contents of this application are incorporated herein by reference in their entirety.

BACKGROUND

The present disclosure relates to an electrostatic latent image developing carrier and a two-component developer.

A two-component developer includes a toner and a carrier. A carrier including a plurality of resin-covered carrier particles is known. The resin-covered carrier particles each include a carrier core and a coat layer covering a surface of the carrier core. For example, resin-covered carrier particles each having a coat layer which contains a fluororesin and a binder resin and in which silica particles are dispersed are known as carrier particles.

SUMMARY

An electrostatic latent image developing carrier according to the present disclosure includes a plurality of carrier particles each including a carrier core, a first coat layer, and a second coat layer. The first and second coat layers cover a surface of the carrier core. The first and second coat layers give a layered structure in which the first coat layer and the second coat layer are layered in order from the surface of the carrier core. The first coat layer contains a fluororesin. The second coat layer contains a silicone resin and a fluorine silane in an amount of at least 1% by mass relative to a mass of the silicone resin. An area $S_A$ and an area $S_B$ satisfy a relationship represented by "$0.05 \leq S_B/(S_A+S_B) \leq 0.50$". The area $S_A$ is an area of a region of a surface region of the first coat layer that is covered with the second coat layer. The area $S_B$ is an area of a region of the surface region of the first coat layer that is not covered with the second coat layer.

A two-component developer according to the present disclosure includes the electrostatic latent image developing carrier according to the present disclosure and a positively chargeable toner capable of being positively charged by friction against the electrostatic latent image developing carrier.

DETAILED DESCRIPTION

Figure 1:
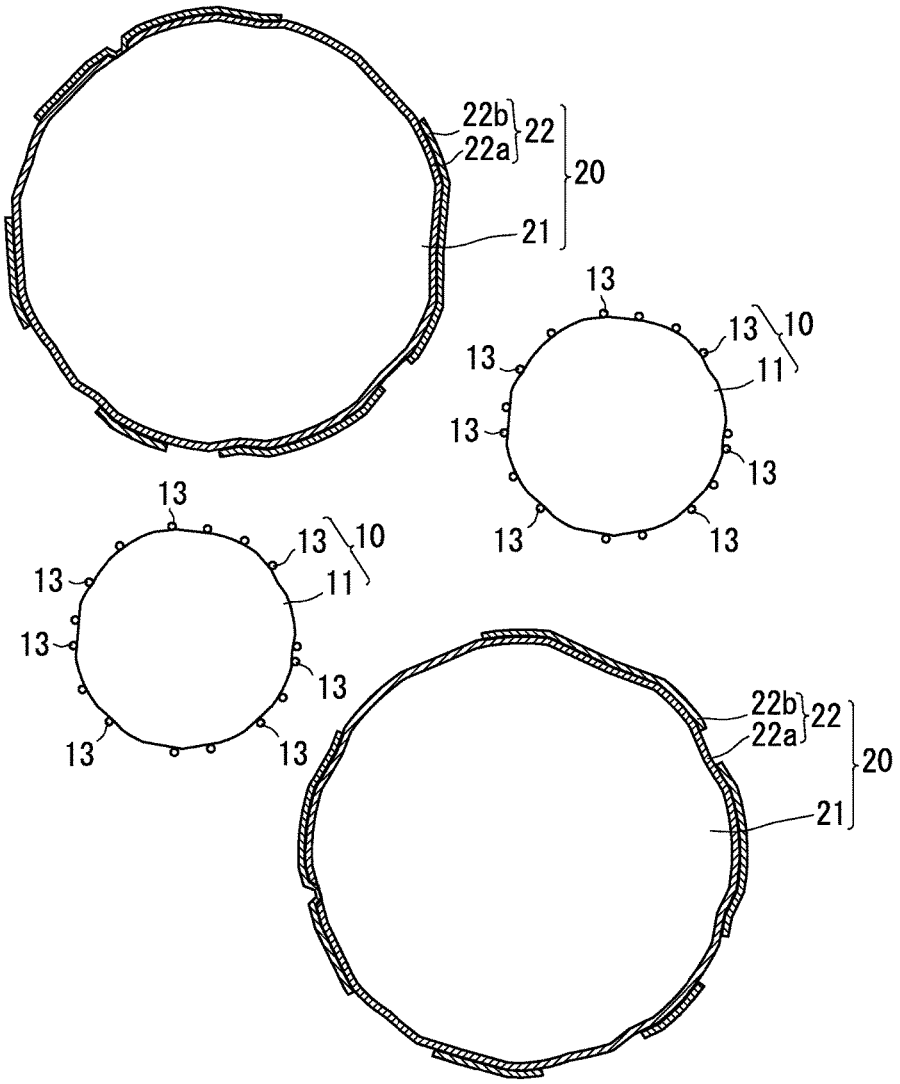
FIG. 1 is a diagram illustrating an example of a sectional structure of a two-component developer according to an embodiment of the present disclosure.

An embodiment of the present disclosure will be described below. Note that unless otherwise stated, results (for example, values indicating shapes or properties) of evaluations that are performed on an aggregated mass of particles (more specifically, toner mother particles, an external additive, a toner, or a carrier) are number averages of measurements made with respect to an appropriate number of particles included in the aggregated mass of the particles.

The number average particle diameter of particles is a number average value of equivalent circle diameters of primary particles (Heywood diameters: diameters of circles having the same areas as projected areas of the particles) measured using a microscope, unless otherwise stated. A measured value of a volume median diameter ($D_{50}$) of particles is a value measured using a laser diffraction/scattering particle size distribution analyzer ("LA-750", product of Horiba, Ltd.), unless otherwise stated.

In the following description, both untreated silica particles (also referred to below as a "silica base") and silica particles obtained through surface treatment on the silica base (that is, surface-treated silica particles) are referred to as "silica particles". Furthermore, silica particles made positively chargeable with a surface treatment agent may be referred to below as "positively chargeable silica particles".

Note that in the present description the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

A carrier according to the present embodiment can be used for example for image formation using an electrophotographic apparatus (image forming apparatus). The following describes an example of image forming methods using an electrophotographic apparatus.

First, an image forming section (for example, a charger and a light exposure device) of the electrophotographic apparatus forms an electrostatic latent image on a photosensitive member (for example, a surface portion of a photosensitive drum) based on image data. Subsequently, a developing device (specifically, a developing device loaded with two-component developer including toner and carrier) of the electrophotographic apparatus supplies the toner to the photosensitive member to develop the electrostatic latent image formed on the photosensitive member. The toner is charged by friction against the carrier in the developing device before being supplied to the photosensitive member. For example, a positively chargeable toner is charged positively. In a development process, the toner (specifically, the charged toner) on a development sleeve (for example, a surface portion of a development roller in the developing device) disposed in the vicinity of the photosensitive member is supplied onto the photosensitive member and attached to a portion of the electrostatic latent image on the photosensitive member that is exposed to light, thereby forming a toner image on the photosensitive member. The developing device is replenished with toner in an amount corresponding to an amount of toner consumed in the development process from a toner container loaded with toner for replenishment use.

In a subsequent transfer process, a transfer device of the electrophotographic apparatus transfers the toner image from the photosensitive member to an intermediate transfer member (for example, a transfer belt), and further transfers the toner image from the intermediate transfer member to a recording medium (for example, paper). Thereafter, a fixing device (fixing method: nip fixing using a heating roller and a pressure roller) of the electrophotographic apparatus fixes the toner on the recording medium by applying heat and pressure to the toner. Through the above, an image is formed on the recording medium. For example, a full color image can be formed by superimposing toner images in four colors of black, yellow, magenta, and cyan. After the transfer process, residual toner on the photosensitive member is removed by a cleaning member (for example, a cleaning blade). Note that the transfer process may be a direct transfer process by which the toner image on the photosensitive member is transferred directly to the recording medium not using the intermediate transfer member. A belt fixing method may be adopted as a fixing method.

A two-component developer includes a toner and a carrier. The toner includes a number of toner particles. The carrier includes a number of carrier particles. The toner included in the two-component developer can be used for example as a positively chargeable toner. The positively chargeable toner is positively charged by friction against the carrier. The carrier particles included in the carrier are magnetic. At least a portion of the carrier particles may be made from a magnetic material (for example, a ferromagnetic material such as ferrite) or made from a resin in which magnetic particles are dispersed in order that the carrier particles are magnetic.

The two-component developer according to the present embodiment has the following features.

(Two-Component Developer According to Present Embodiment)

The two-component developer includes a carrier according to the present embodiment having the following features (also referred to below as basic features) and a positively chargeable toner capable of being positively charged by friction against the carrier. The positively chargeable toner includes for example a plurality of toner particles each including a toner mother particle and an external additive attached to a surface of the toner mother particle. Particularly preferably, the external additive includes positively chargeable silica particles in order to improve positive chargeability of the toner.

(Basic Features of Carrier)

The carrier includes a plurality of carrier particles each including a carrier core, a first coat layer, and a second coat layer. The first and second coat layers cover a surface of the carrier core. The first and second coat layers give a layered structure in which the first coat layer and the second coat layer are layered in order from the surface of the carrier core. The first coat layer contains a fluororesin. The second coat layer contains a silicone resin and a fluorine silane in an amount of at least 1% by mass relative to a mass of the silicone resin. An area $S_A$ of a region of a surface region of the first coat layer that is covered with the second coat layer and an area $S_B$ of a region of the surface region of the first coat layer that is not covered with the second coat layer satisfy a relationship represented by "$0.05 \leq S_B/(S_A+S_B) \leq 0.50$".

In the aforementioned basic features, the second coat layer may directly cover the surface of the carrier core or indirectly cover the surface of the carrier core with the first coat layer therebetween. The second coat layer may be located only on the first coat layer or have a part in contact with the surface of the carrier core (specifically, a region of the surface of the carrier core that is not covered with the first coat layer). The first coat layer may completely cover the surface of the carrier core.

In the aforementioned basic features, the relationship represented by "$0.05 \leq S_B/(S_A+S_B) \leq 0.50$" being satisfied means that an area rate of the region of the surface region of the first coat layer that is not covered with the second coat layer is at least 5% and no greater than 50%. In the following description, the area rate ($=S_B/(S_A+S_B)$) of the region of the surface region of the first coat layer that is not covered with the second coat layer may be referred to as a "first coat layer exposure rate".

A two-component developer includes a toner and a carrier. When the two-component developer is stirred, the toner is charged by friction between the toner and the carrier. In a configuration in which the toner is positively chargeable, an external additive (for example, positively chargeable silica particles) may be attached to surfaces of toner mother particles of the positively chargeable toner in some cases in order to increase positive chargeability of the toner. Resin-covered carrier particles may be used in the two-component developer in order to improve for example charging ability (specifically, a property of charging the toner) of the carrier. The resin-covered carrier particles each include a carrier core and a coat layer (specifically, a resin layer) covering a surface of the carrier core. Charging ability of carrier cores covered with the coat layers tends to be greater than that of carrier cores (that is, carrier cores not covered with coat layers). However, when the external additive detached from the toner mother particles through stirring as above is attached to surfaces of the carrier particles, charging ability of the carrier particles tends to decrease. Furthermore, abrasion of the coat layers due to stirring as above tends to reduce charging ability of the carrier particles.

The coat layers preferably contain a fluororesin in order to improve charging ability of the carrier particles to the positively chargeable toner. The reason therefor is that fluororesin has strong negative chargeability. However, in order to inhibit abrasion of the coat layers caused through stirring, the coat layers preferably contain a silicone resin that is more excellent in durability than the fluororesin.

In order to improve charging ability of the carrier particles while inhibiting abrasion of the coat layers, containment of both a fluororesin and a resin excellent in durability in the coat layer can be considered. However, the fluororesin is non-uniformly dispersed in such a coat layer, with a result that the coat layer tends to be non-uniformly charged. When the coat layer is non-uniformly charged, the external additive detached from the toner mother particles tends to be attached to the carrier particles. The reason therefor is thought to be that a local part of the coat layer that is excessively charged attracts the external additive by static attraction.

The carrier having the aforementioned basic features has a layered structure in which the first coat layer and the second coat layer, which cover the surface of the carrier core, are layered in order from the surface of the carrier core. The first coat layer contains a fluororesin. The second coat layer contains a silicone resin and a fluorine silane in an amount of at least 1% by mass relative to a mass of the silicone resin. The second coat layer, which contains the silicone resin, has excellent durability. Furthermore, the fluorine silane acts to increase negative chargeability of the second coat layer.

As a result of the first coat layer exposure rate being set at an appropriate value, it becomes easy to ensure sufficient charging ability of the carrier particles both in the initial stage of printing and after continuous printing. Specifically, as the first coat layer exposure rate is increased, negative chargeability of the carrier particles increases through exposed parts of the first coat layers with a result that charging ability of the carrier particles in the initial stage of printing tends to increase. The second coat layer, which contains a fluorine silane, has charging ability proximate to that of the fluororesin. When a difference in charging ability between the first and second coat layers is small, the surfaces of the carrier particles tend to have uniform chargeability. When the surfaces of the carrier particles have uniform chargeability, the external additive detached from the toner mother particles is hardly attached to the carrier particles. In order that the surfaces of the carrier particles have uniform chargeability, the amount of the fluorine silane in the second coat layer is preferably at least 5% by mass and no greater than 50% by mass relative to a mass of the silicone resin in the second coat layer, and particularly preferably at least 25% by mass and no greater than 35% by mass.

Furthermore, in a part of the surface of the carrier particle where the first and second coat layers overlap with each other, the second coat layer is abraded as continuous printing proceeds. When the second coat layer is abraded, influence of the first coat layer on the surface of the carrier particle tends to be strong. As continuous printing proceeds, charging ability of the carrier particles tends to decrease due to adhesion of the external additive and the like. However, strong influence of the first coat layer resulting from abrasion of the second coat layer increases charging ability of the carrier particles to prevent decrease in charging ability of the carrier particles.

As described above, the carrier having the aforementioned basic features has sufficient charging ability both in the initial stage of printing and after continuous printing.

The carrier cores are preferably ferrite particles. The ferrite particles tend to be magnetic enough for image formation. Ferrite particles produced by a typical production method tend not to be perfectly spherical and tend to have appropriate projections and recesses on surfaces thereof. Specifically, the surfaces of the ferrite particles tend to have an arithmetic mean roughness (specifically, arithmetic mean roughness Ra defined in Japanese Industrial Standard (JIS) B0601-2013) of at least 0.3 μm and no greater than 2.0 μm. It is thought that as a result of the surfaces of the carrier cores having appropriate roughness, adhesion between the surface of the carrier core and the first coat layer increases to inhibit peeling off of the first coat layer.

However, when the ferrite particles are exposed as the surfaces of the carrier particles, charge generated on the surfaces of the carrier particles by frictional charging tends to leak. Charge leakage as above may cause an image defect. In view of the foregoing, in a configuration in which the carrier cores are the ferrite particles in the aforementioned basic features, it is preferable that: the first coat layer covers at least 85% and no greater than 98% of a surface region of the carrier core; and the second coat layer completely covers a region of the surface region of the carrier core that is exposed through the first coat layer, and is present also on the first coat layer. When the first and second coat layers cover the carrier core (specifically, a ferrite particle) in a fashion as above, the surface of the carrier core is completely covered with either the first coat layer or the second coat layer and no exposed part is present in the surface region of the carrier core. In the absence of an exposed part, the aforementioned charge leakage can be inhibited. Moreover, in the presence of the resin layer on the surface of the carrier particle, sufficient charging ability of the carrier can be ensured easily.

Furthermore, it is preferable that the first coat layer has a thickness of at least 100 nm and no greater than 450 nm and the second coat layer has a thickness of at least 100 nm and no greater than 550 nm in order to ensure sufficient charging ability of the carrier in continuous printing. Even in a configuration in which each coat layer is thin, the multi-layered structure of the coat layers can facilitate complete covering of the surface of the carrier core. When the second coat layer additionally covers the surface of the carrier core covered with the first coat layer (also referred to below as a first coat particle), the surface of the carrier core can be completely covered with the first and second coat layers with ease. In order to completely cover the surface of the carrier core with a single coat layer, the coat layer is required to be rather thick. An excessively thick coat layer tends to have poor film quality. The excessively thick coat layer also tends to reduce magnetism of the carrier particle.

The thickness of a coat layer can be determined through analysis on a TEM image of a section of a carrier particle using a commercially available image analysis software (for example, "WinROOF", product of Mitani Corporation). The carrier particle can be sectioned for example using a sectional specimen preparation apparatus ("CROSS SECTION POLISHER (registered Japanese trademark), product of JEOL Ltd.). If the thickness of a coat layer is not uniform for a single carrier particle, the thickness of the coat layer is measured at each of four locations that are approximately evenly spaced (specifically, four locations at which the coat layer intersects with two straight lines perpendicularly intersecting with each other at substantially the center of the cross section of the carrier particle) and the arithmetic mean of the four measured values is determined to be an evaluation value (thickness of the coat layer) for the carrier particle. Note that in a situation in which a boundary between a carrier core and a coat layer is unclear in the TEM image, the boundary between the carrier core and the coat layer can be clarified by mapping characteristic elements contained in the coat layer in the TEM image through a combination of TEM and electron energy loss spectroscopy (EELS). Alternatively, the boundary between the carrier core and the coat layer may be clarified by SEM-energy dispersive X-ray spectroscopy (EDX).

In a first preferable example of the electrostatic latent image developing carrier having the aforementioned basic features, an amount of the fluorine silane in the second coat layer is at least 5% by mass and no greater than 50% by mass relative to the mass of the silicone resin; an amount of the fluororesin in the first coat layer is at least 40% by mass and no greater than 60% by mass relative to a total mass of the fluororesin in the first coat layer and the silicone resin in the second coat layer; and the first coat layer exposure rate is at least 25% and no greater than 40%. That is, $S_A$ and $S_B$ satisfy the relationship represented by "$0.25 \leq S_B/(S_A+S_B) \leq 0.40$" in the aforementioned basic features.

In a second preferable example of the electrostatic latent image developing carrier having the aforementioned basic features, an amount of the fluorine silane in the second coat layer is at least 5% by mass and no greater than 50% by mass relative to the mass of the silicone resin; an amount of the fluororesin in the first coat layer is at least 10% by mass and no greater than 20% by mass relative to a total mass of the fluororesin in the first coat layer and the silicone resin in the second coat layer; and the first coat layer exposure rate is at least 5% and no greater than 15%. That is, $S_A$ and $S_B$ satisfy the relationship "$0.05 \leq S_B/(S_A+S_B) \leq 0.15$" in the aforementioned basic features.

FIG. 1 illustrates composition of the two-component developer according to the present embodiment. The two-component developer illustrated in FIG. 1 includes a plurality of toner particles 10 and a plurality of carrier particles 20.

The toner particles 10 each include a toner mother particle 11 and an external additive (specifically, a plurality of external additive particles 13) attached to a surface of the toner mother particle 11. The external additive particles 13 may be inorganic particles (for example, silica particles surface-treated with aminosilane) or resin particles.

The carrier particles 20 each include a carrier core 21 and a coat layer 22 covering a surface of the carrier core 21. The coat layer 22 includes a first coat layer 22*a* and a second coat layer 22*b*. The first coat layer 22*a* and the second coat layer 22*b* each are a resin film.

Figure 2:
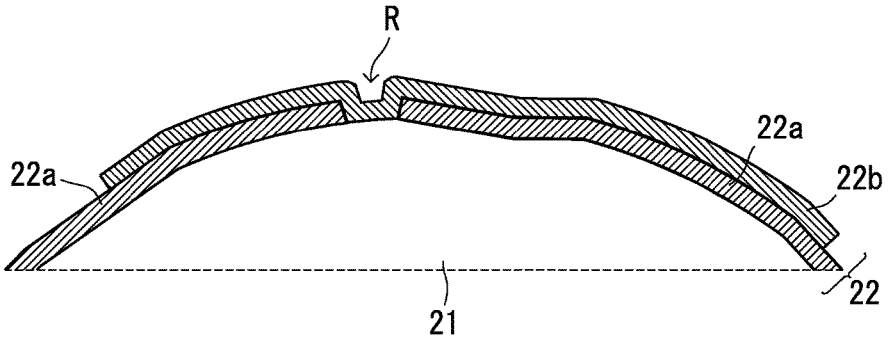
FIG. 2 is a diagram illustrating in an enlarged scale a part of a surface of a carrier particle illustrated in FIG. 1.

FIG. 2 illustrates a surface layer portion of a carrier particle 20 in an enlarged scale. As illustrated in FIG. 2, the first and second coat layers 22*a* and 22*b* give a layered structure in which the first coat layer 22*a* and the second coat layer 22*b* are layered in order from the surface of the carrier core 21. The first coat layer 22*a* covers for example at least 85% and no greater than 98% of a surface region of the carrier core 21. The second coat layer 22*b* completely covers a region of the surface region of the carrier core 21 that is exposed through the first coat layer 22*a* (for example, a region R in FIG. 2), and is also present on the first coat layer 22*a*. The surface region of the carrier core 21 is completely covered with either the first coat layer 22*a* or the second coat layer 22*b*, and no exposed part is present in the surface region of the carrier core 21. The first coat layer exposure rate of the first coat layer 22*a* is at least 5% and no greater than 50%.

The toner particles included in the toner may each be a toner particle including no shell layer (also referred to below as a non-capsule toner particle) or a toner particle including a shell layer (also referred to below as a capsule toner particle). Capsule toner particles can be produced by forming shell layers on surfaces of non-capsule toner particles (toner cores) to which an external additive is yet to be added. The shell layers may be made substantially from a thermosetting resin only or a thermoplastic resin only, or may contain both a thermoplastic resin and a thermosetting resin.

Non-capsule toner particles can be produced for example by a pulverization method or an aggregation method. These methods can facilitate favorable dispersion of an internal additive in a binder resin of the non-capsule toner particles.

In an example of the pulverization method, a binder resin, a colorant, a charge control agent, and a releasing agent are mixed first. Subsequently, the resultant mixture is melt-kneaded using a melt-kneader (for example, a single-screw or twin-screw extruder). The resultant melt-kneaded substance is pulverized and the resultant pulverized product is classified then. Through the above, toner mother particles having a desired particle diameter are obtained.

In an example of the aggregation method, binder resin fine particles, releasing agent fine particles, and colorant fine particles are caused to aggregate in an aqueous medium including these fine particles until particles of a desired diameter are obtained. As a result, aggregated particles including the binder resin, the releasing agent, and the colorant are formed. Subsequently, the resultant aggregated particles are heated to coalesce components included in the aggregated particles. Through the above, toner mother particles having a desired particle diameter are obtained.

Any shell layer forming method can be employed in production of capsule toner particles. The shell layers may be formed for example by in-situ polymerization, in-liquid curing film coating process, or coacervation.

The following describes preferable examples of respective configurations of the non-capsule toner particle and the carrier particle. Note that the toner particle may include an external additive. In a configuration in which the toner particle includes an external additive, the toner particle includes a toner mother particle and the external additive. However, the external additive may be omitted if unnecessary. In a situation in which the external additive is omitted, the toner mother particle and the toner particle are equivalent.

[Non-Capsule Toner Particles: Toner Mother Particles]

The toner mother particles contain a binder resin. The toner mother particles may optionally contain an internal additive (for example, at least one of a colorant, a releasing agent, a charge control agent, and a magnetic powder).

(Binder Resin)

Typically, a binder resin is a main component of a toner. In a preferable example of a magnetic toner including a magnetic powder, a binder resin occupies approximately 60% by mass of toner cores. In a preferable example of a non-magnetic toner including no magnetic powder, a binder resin occupies approximately 85% by mass of toner cores. Properties of the binder resin are therefore expected to have great influence on an overall property of the toner mother particles. In order to achieve both heat-resistant preservability and low-temperature fixability of the toner, the toner mother particles particularly preferably contain at least one of a polyester resin and a styrene-acrylic acid-based resin as a binder resin.

(Colorant)

The toner mother particles may optionally contain a colorant. The colorant can be for example a known pigment or dye selected to match the color of the toner. In order to obtain a toner suitable for image formation, the amount of the colorant is preferably at least 1 part by mass and no greater than 20 parts by mass relative to 100 parts by mass of the binder resin.

The toner mother particles may contain a black colorant. Carbon black may be used as a black colorant. Alternatively, the black colorant may be a colorant that is adjusted to a black color using a yellow colorant, a magenta colorant, and a cyan colorant.

The toner mother particles may contain a non-black colorant such as a yellow colorant (specific examples include Naphthol Yellow, Monoazo Yellow, Diazo Yellow, Disazo Yellow, and anthraquinone compounds), a magenta colorant (specific examples include quinacridone compounds, naphthol compounds, Carmine 6B, and Monoazo Red), or a cyan colorant (specific examples include Phthalocyanine Blue and anthraquinone compounds).

(Releasing Agent)

The toner mother particles may optionally contain a releasing agent. The releasing agent is used for example for the purpose to improve fixability or offset resistance of the toner. In order to improve fixability or offset resistance of the toner, the amount of the releasing agent is preferably at least 1 part by mass and no greater than 30 parts by mass relative to 100 parts by mass of the binder resin.

Examples of releasing agents that can be preferably used include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a main component such as montanic acid ester wax and castor wax; and waxes in which a fatty acid ester has been partially or fully deoxidized such as deoxidized carnauba wax. One of the releasing agents listed above may be used independently, or two or more of the releasing agents listed above may be used in combination.

(Charge Control Agent)

The toner mother particles may optionally contain a charge control agent. The charge control agent is used for example for the purpose to improve charge stability or a charge rise characteristic of the toner. The charge rise characteristic of a toner is an indicator as to whether the toner can be charged to a specific charge level in a short period of time.

Cationic strength of the toner mother particles can be increased through the toner mother particles containing a positively chargeable charge control agent (specific examples include pyridine, nigrosine, and quaternary ammonium salt). However, in a configuration in which sufficient chargeability of the toner can be ensured, the toner mother particles need not contain a charge control agent.

(Magnetic Powder)

The toner mother particles may optionally contain a magnetic powder. Examples of materials of the magnetic powder that can be preferably used include ferromagnetic metals (specific examples include iron, cobalt, nickel, and alloy containing one or more of these metals), ferromagnetic metal oxides (specific examples include ferrite, magnetite, and chromium dioxide), and materials subjected to ferromagnetization (specific examples include carbon materials made ferromagnetic through thermal treatment). Magnetic particles subjected to surface treatment are preferably used as a magnetic powder in order to inhibit elution of metal ions (for example, iron ions) from the magnetic powder. One magnetic powder listed above may be used independently, or two or more magnetic powders listed above may be used in combination.

[Non-Capsule Toner Particles: External Additive]

An external additive (specifically, an external additive including a plurality of external additive particles) may be attached to a surface of each of the toner mother particles. Unlike the internal additive, the external additive is not present within a toner mother particle, and is selectively present only on the surface of the toner mother particle (a surface layer portion of the toner particle). The external additive particles can be attached to the surfaces of the toner mother particles for example by stirring the toner mother particles and the external additive (particles) together. The toner mother particle and the external additive particles do not chemically react with each other and are connected together physically rather than chemically. Connection strength between the toner mother particle and the external additive particles can be adjusted by controlling stirring conditions (more specifically, stirring time period, rotational speed for stirring, and the like) and particle size, shape, and surface conditions of the external additive particles.

Inorganic particles are preferable as external additive particles, and silica particles or particles of metal oxides (specific examples include alumina, titanium oxide, magnesium oxide, zinc oxide, strontium titanate, and barium titanate) are particularly preferable. Alternatively or additionally, resin particles or particles of an organic acid compound such as a fatty acid metal salt (specific examples include zinc stearate) may be used as external additive particles. A complex of plural materials in the form of composite particles may be used as external additive particles. One of the external additives listed above may be used independently, or two or more of the external additives listed above may be used in combination.

The external additive particles may be subjected to surface treatment. For example, in a configuration in which silica particles are used as external additive particles, surfaces of the silica particles may be made hydrophobic and/or positively chargeable with a surface treatment agent. Examples of surface treatment agents that can be preferably used include coupling agents (specific examples include silane coupling agents, titanate coupling agents, and aluminate coupling agents) and silicone oils (specific examples include dimethylsilicone oil). In order to improve positive chargeability of the toner, the external additive preferably includes positively chargeable silica particles and particularly preferably includes silica particles surface-treated with aminosilane.

Use of inorganic particles having a number average primary particle diameter of at least 5 nm and no greater than 30 nm as external additive particles is preferable in order to improve fluidity of the toner. In order to improve heat-resistant preservability of the toner through the external additive functioning as a spacer among the toner particles, it is preferable to use resin particles having a number average primary particle diameter of at least 50 nm and no greater than 200 nm as the external additive particles.

The amount of the external additive (where plural types of external additive particles are used, a total amount thereof) is preferably at least 0.5 parts by mass and no greater than 10 parts by mass relative to 100 parts by mass of the toner mother particles in order to cause the external additive to sufficiently function as an external additive while inhibiting detachment of the external additive particles from the toner particles.

[Carrier Particles]

The carrier having the aforementioned basic features includes carrier particles each including a carrier core, a first coat layer, and a second coat layer. The first and second coat layers cover a surface of the carrier core. The first and second coat layers give a layered structure in which the first coat layer and the second coat layer are layered in order from the surface of the carrier core. The carrier particles each having such a layered structure are obtained in a manner that the first coat layers are formed on the surfaces of the carrier cores to obtain first coat particles (specifically, a complex of the carrier cores and the first coat layers) and the second coat layers are formed on surfaces of the first coat particles. All part of the first coat layer is located closer to the carrier core than the second coat layer. That is, there is no part of the carrier core in which the second coat layer and the first coat layer are layered in order from the surface of the carrier core.

(Carrier Cores)

The carrier cores preferably contain a magnetic material. The carrier cores may be particles of a magnetic material or may contain a binder resin in which particles of a magnetic material are dispersed. Examples of magnetic materials that can be contained in the carrier cores include ferromagnetic metals (specific examples include iron, cobalt, nickel, and alloy including at least one of them) and oxides of ferromagnetic metals (specific examples include ferrites). Examples of preferable ferrites include magnetite (spinel ferrite), barium ferrite, Mn ferrite, Mn—Zn ferrite, Ni—Zn ferrite, Mn—Mg ferrite, Ca—Mg ferrite, Li ferrite, Cu—Zn ferrite, and Mn—Mg—Sr ferrite. As a material of the carrier cores, one of the magnetic materials listed above may be used independently or two or more magnetic materials listed above may be used in combination. Commercially available carrier cores may be used. Alternatively, self-made carrier cores may be produced by pulverizing and baking a magnetic material. Saturation magnetization of the carrier can be adjusted by changing the amount of the magnetic material (particularly, a ratio of a ferromagnetic material) in carrier core production. Roundness of the carrier can be adjusted by changing baking temperature in carrier core production.

(First Coat Layers)

The first coat layers in the carrier having the aforementioned basic features contain a fluororesin. At least one selected from the group consisting of polyvinyl fluoride, polyvinylidene fluoride, polytetrafluoroethylene (PTFE), polytrifluoroethylenes (a specific example is polychlorotrifluoroethylene), polyhexafluoropropylene, tetrafluoroethylene-hexafluoropropylene copolymer (FEP), and tetrafluoroethylene-perfluoroalkylvinylether copolymer (PFA) is preferable as the fluororesin. FEP or PFA is particularly preferable.

(Second Coat Layers)

The second coat layers in the carrier having the aforementioned basic features contain a silicone resin and a fluorine silane in an amount of at least 1% by mass relative to a mass of the silicone resin.

A methyl silicone resin or a methylphenyl silicone resin is particularly preferable as the silicone resin. The silicone resin has siloxane bonds "Si—O—Si" that each are a main chain and organic groups that each are a side chain. The organic groups that each are a side chain of the methyl silicone resin include only a methyl group. The organic groups that each are a side chain of the methylphenyl silicone resin include a methyl group and a phenyl group. In order that the silicone resin has excellent durability, it is preferable that the main chains (siloxane bonds: Si—O—Si) are three-dimensionally connected together. The silicone resin is a thermosetting resin.

Examples of fluorine silanes include fluorine-containing silane coupling agents such as $CF_3CH_2CH_2Si(OCH_3)_3$, $C_4F_9CH_2CH_2Si(OCH_3)_3$, $C_8F_{17}CH_2CH_2Si(OCH_3)_3$, $C_7F_{15}COOCH_2CH_2CH_2Si(OCH_3)_3$, $C_7F_{15}COSCH_2CH_2CH_2Si(OCH_3)_3$, $C_7F_{15}CONHCH_2CH_2CH_2Si(OC_2H_5)_3$, $C_7F_{15}CONHCH_2CH_2CH_2Si(OCH_3)_3$, $C_8F_{17}SO_2NHCH_2CH_2CH_2Si(OC_2H_5)_3$, $C_8F_{17}CH_2CH_2SCH_2CH_2Si(OCH_3)_3$, $C_{10}F_{2i}CH_2CH_2SCH_2CH_2Si(OCH_3)_3$, $C_8F_{17}CH_2CH_2SiCH_3(OCH_3)_2$, $C_8F_{17}SO_2N(CH_2CH_2CH_3)CH_2CH_2CH_2Si(OCH_3)_3$, and $C_8F_{17}SO_2NHCH_2CH_2N(SO_2C_8F_{17})CH_2CH_2CH_2Si(OCH_3)_3$.

EXAMPLES

Examples of the present disclosure will be described below. Table 1 shows carriers (electrostatic latent image developing carriers) CA-1 to CA-10 and CB-1 to CB-4 according to Examples and Comparative Examples.

TABLE 1

| Carrier | | | | |
|---|---|---|---|---|
| | First coat layer | | Second coat layer | |
| Type | Fluororesin [part by mass] | Exposure rate | Silicone resin [part by mass] | Fluorine silane [% by mass] |
| CA-1 | 0.8 | 0.31 | 1.2 | 20 |
| CA-2 | 0.8 | 0.29 | 1.2 | 10 |
| CA-3 | 0.8 | 0.25 | 1.2 | 30 |
| CA-4 | 0.8 | 0.30 | 1.2 | 5.0 |
| CA-5 | 1.2 | 0.40 | 0.8 | 15 |
| CA-6 | 1.2 | 0.39 | 0.8 | 5.0 |
| CA-7 | 0.4 | 0.13 | 1.6 | 25 |
| CA-8 | 0.4 | 0.10 | 1.6 | 15 |
| CA-9 | 0.2 | 0.06 | 1.8 | 30 |
| CA-10 | 1.4 | 0.50 | 0.6 | 1.0 |
| CB-1 | 0.8 | 0.27 | 1.2 | 0.0 |
| CB-2 | 1.2 | 0.38 | 0.8 | 0.5 |
| CB-3 | 1.6 | 0.60 | 0.4 | 1.0 |
| CB-4 | Single layer (silicone resin layer) | | | |

Amounts shown under "Fluororesin" and "Silicone resin" in Table 1 indicate amounts of respective resins relative to 100 parts by mass of carrier cores.

"Exposure rate" under "First coat layer" in Table 1 corresponds to "$S_B/(S_A+S_B)$" in the aforementioned basic features. $S_A$ represents an area of a region of a surface region of the first coat layer covering a surface of the carrier core, which region is covered with the second coat layer. $S_B$ represents an area of a region of the surface region of the first coat layer covering the surface of the carrier core, which region is not covered with the second coat layer.

The amounts (unit: % by mass) shown under "Fluorine silane" of "Second coat layer" in Table 1 each indicate a mass ratio of the fluorine silane relative to a mass of the silicone resin in the second coat layer.

The following describes production methods, evaluation methods, and evaluation results for the carriers CA-1 to CA-10 and CB-1 to CB-4. In evaluations in which errors may occur, an evaluation value was calculated by calculating the arithmetic mean of an appropriate number of measured values in order to ensure that any errors were sufficiently small.

[Toner Production]

(Preparation of Toner Mother Particles)

An FM mixer ("FM-20B", product of Nippon Coke & Engineering Co., Ltd.) was used to mix 100 parts by mass of a polyester resin ("XPE258", product of Mitsui Chemicals, Inc.), 9 parts by mass of an ester wax ("NISSAN ELECTOL (registered Japanese trademark) WEP-3", product of NOF Corporation), 9 parts by mass of a carbon black ("MA100", product of Mitsubishi Chemical Corporation), and 1 part by mass of a quaternary ammonium salt ("BONTRON (registered Japanese trademark) P-51", product of ORIENT CHEMICAL INDUSTRIES, Co., Ltd.) for 4 minutes at a rotational speed of 2,000 rpm.

Subsequently, the resultant mixture was melt-kneaded using a twin-screw extruder ("PCM-30", product of Ikegai Corp.) under conditions of a melt-kneading temperature (cylinder temperature) of 100° C., a shaft rotational speed of 150 rpm, and a treatment rate of 100 g/minute. Thereafter, the resultant melt-kneaded product was cooled while being rolled. Next, the resultant melt-kneaded product was coarsely pulverized using a pulverizer ("ROTOPLEX (registered Japanese trademark), product of Hosokawa Micron Corporation) under a condition of a set particle diameter of 2 mm. The resultant coarsely pulverized product was then finely pulverized using a mechanical pulverizer ("Turbo Mill Type RS", product of FREUND-TURBO CORPORATION). Subsequently, the resultant finely pulverized product was classified using a classifier (air classifier utilizing Coanda effect, "Elbow Jet Type EJ-LABO", product of Nittetsu Mining Co., Ltd.). As a result, toner mother particles having a volume median diameter ($D_{50}$) of 6.7 μm were obtained.

(External Addition)

Next, external addition was performed on the toner mother particles prepared as above. Specifically, 100 parts by mass of the toner mother particles, 1 part by mass of conductive titanium oxide particles ("EC-100", product of Titan Kogyo, Ltd., base material: $TiO_2$, coat layer: Sb-doped $SnO_2$ layer, volume median diameter: approximately 0.35 μm), and 1 part by mass of positively chargeable silica particles ("AEROSIL (registered Japanese trademark) REA90", product of Nippon Aerosil Co., Ltd., content: dry silica particles made positively chargeable through surface treatment, number average primary particle diameter: approximately 20 nm) were mixed together for 5 minutes using an FM mixer ("FM-10B", product of Nippon Coke & Engineering Co., Ltd.) at a rotational speed of 3,500 rpm. The above mixing attached external additives (titanium oxide particles and silica particles) to surfaces of the toner mother particles. The resultant particles were sifted using a 200-mesh sieve (sieve opening: 75 μm). Through the above, a positively chargeable toner including a number of toner particles (non-capsule toner particles) was produced.

[Preparation of Carrier Cores]

Appropriate amounts of raw materials (raw materials of MnO, MgO, and $Fe_2O_3$) were blended so as to be 40 parts by mass in terms of MnO (volume median diameter: 0.9 μm), 10 parts by mass in terms of MgO (volume median diameter: 0.9 μm), and 50 parts by mass in terms of $Fe_2O_3$ (volume median diameter: 0.8 μm). Water was then added to the raw materials. Next, the raw materials were crushed for 2 hours using a wet ball mill, and mixed. Subsequently, the resultant mixture was dried and granulated using a spray dryer. Thereafter, 5-hour baking at a temperature of 1,000° C. was performed to obtain carrier cores (a manganese-containing ferrite carrier) having a volume median diameter of 40 μm and a saturation magnetization of 65 $Am^2/kg$ in a magnetic field of 3,000 ($10^3/4\pi \cdot A/m$).

[Production of Carriers CA-1 to CA-10 and CB-1 to CB-3]

First coating and second coating as described below were performed on the carrier cores in production of each of the carriers CA-1 to CA-10 and CB-1 to CB-3.

(First Coating)

A tetrafluoroethylene-hexafluoropropylene copolymer (FEP) was dispersed in methyl ethyl ketone to give a first coating liquid. The carrier cores (particles) prepared according to the procedure described above were loaded into a flow coating machine ("Multiplex MP-01", product of Powrex Corporation), and fluidized therein. The first coating liquid including FEP in an amount as shown under "Fluororesin" in Table 1 was applied by spray-coating to the fluidized carrier cores using the flow coating machine. Amounts shown under "Fluororesin" in Table 1 each indicate an amount of fluororesin relative to 100 parts by mass of the carrier cores. For example, 0.8 parts by mass of FEP relative to 100 parts by mass of the carrier cores was coated in production of the carrier CA-1. As a result, first coat particles (specifically, carrier cores coated with the first coat layers) were obtained. The first coat layers of each of the carriers CA-1 to CA-10 and CB-1 to CB-3 had a thickness of at least 100 nm and no greater than 450 nm. The thickness and coverage ratio of the first coat layers tended to be larger as the amount of spray-coating FEP (that is, FEP applied to the carrier cores) was increased.

(Second Coating)

A resin solution was obtained by dissolving a methyl silicone resin in an amount of 100 g in terms of a solid content in 500 mL of toluene. Subsequently, a fluorine silane in an amount shown under "Fluorine silane" in Table 1 was added to the resultant resin solution to give a second coating liquid. Trimethoxy(3,3,3-trifluoropropyl)silane (product of Tokyo Chemical Industry Co., Ltd.) was used as the fluorine silane. In production of for example the carrier CA-1, 20% by mass of fluorine silane relative to a solid content of methyl silicone resin in the resin solution was added to give the second coating liquid. No fluorine silane was added in production of the carrier CB-1. In production of the carrier CB-1, the resin solution is equivalent to the second coating liquid.

The first coat particles prepared according to the above described procedure were loaded into a flow coating machine ("Multiplex MP-01", product of Powrex Corporation), and fluidized therein. The second coating liquid including methyl silicone resin in an amount shown under "Silicone resin" in Table 1 was applied by spray-coating to the fluidized first coat particles using the flow coating machine. Amounts shown under "Silicone resin" in Table 1 each indicate an amount of silicone resin relative to 100 parts by mass of the carrier cores. For example, 1.2 parts by mass of methyl silicone resin relative to 100 parts by mass of the carrier cores was coated in production of the carrier CA-1.

Subsequently, thermal treatment at a temperature of 270° C. was performed on a fluidized bed in the flow coating machine for 2 hours to harden the first and second coating liquids. Through the above, a carrier (each of the carriers CA-1 to CA-10 and CB-1 to CB-3) including a number of carrier particles was produced. The second coat layers of each of the carriers CA-1 to CA-10 and CB-1 to CB-3 had a thickness of at least 100 nm and no greater than 550 nm. The thickness and coverage ratio of the second coat layers tended to be larger as the amount of the spray-coating methyl silicone resin (that is, methyl silicone resin applied to the carrier cores) was increased.

Measurement results of a first coat layer exposure rate (specifically, "$S_B/(S_A+S_B)$") in each of the carriers CA-1 to CA-10 and CB-1 to CB-3 produced as described above were as shown in Table 1. For example, the first coat layer exposure rate was 31% (=0.31) in the carrier CA-1. The first coat layer exposure rate was measured as follows.

<Method for Measuring First Coat Layer Exposure Rate>

A scanning electron microscope (SEM) image of a carrier particle included in a measurement target (one of the carriers CA-1 to CA-10 and CB-1 to CB-3) was captured using a SEM. A covered area ($=S_A+S_B$) and an exposed area ($=S_B$) of a first coat layer of the carrier particle were calculated from the captured SEM image.

SEM image capturing at low accelerating voltage can obtain a SEM image showing a surface of a carrier particle. In view of the foregoing, a carrier particle was captured at an accelerating voltage of 0.5 kV. A SEM image captured at an accelerating voltage of 0.5 kV showed a surface condition of the carrier particle. In a surface region of the carrier particle in the SEM image captured at an accelerating voltage of 0.5 kV, a region where a first coat layer (that is, a fluororesin layer) was exposed had a relatively high brightness while the other regions (that is, a region where a second coat layer was exposed and a region where a carrier core was exposed) each had a relatively low brightness. In the surface region of the carrier particle, the region where fluororesin was exposed had a higher brightness than the region where silicone resin was exposed.

Besides, SEM image capturing at high accelerating voltage can obtain a SEM image showing an interior of a carrier particle (specifically, a part deep in the carrier particle from a surface thereof). In view of the foregoing, a carrier particle was captured at an accelerating voltage of 5.0 kV. A SEM image captured at an accelerating voltage of 5.0 kV showed a surface condition of a carrier core. In a surface region of the carrier core in the SEM image captured at an accelerating voltage of 5.0 kV, a region covered with a first coat layer had a relatively high brightness while the other regions (that is, a region covered with a second coat layer and a region covered with neither the first coat layer nor the second coat layer) each had a relatively low brightness. In the surface region of the carrier core, a region where fluororesin was present had a higher brightness than a region where silicone resin was present.

A covered area of the first coat layer was calculated through image analysis on the SEM image captured at an accelerating voltage of 5.0 kV. In the image analysis, brightness was divided into 256 by setting a brightness of 255 as a value for the brightest part of the SEM image and setting a brightness of 0 as a value for the darkest part thereof. Binarization with a specific threshold value (for example, an average brightness) was then performed to obtain a monochrome image (black: pixels having a brightness of less than the threshold value, white: pixels having a brightness of the threshold value or higher). A total area of regions of the surface region of the carrier core where the first coat layer was present (that is, the covered area of the first coat layer) was calculated from the number of white pixels on the obtained monochrome image.

An exposed area of the first coat layer was calculated through image analysis on the SEM image captured at an accelerating voltage of 0.5 kV. In the image analysis, brightness was divided into 256 by setting a brightness of 255 as a value for the brightest part of the SEM image and setting a brightness of 0 as a value for the darkest part thereof. Binarization with a specific threshold value (for example, an average brightness) was then performed to obtain a monochrome image (black: pixels having a brightness of less than the threshold value, white: pixels having a brightness of the threshold value or higher). A total area of regions of the surface region of the carrier particle where fluororesin was exposed (that is, an exposed area of the first coat layer) was calculated from the number of white pixels on the obtained monochrome image.

A first coat layer exposure rate was calculated based on the covered area and the exposed area of the first coat layer calculated as above. A value obtained by dividing the exposed area of the first coat layer by the covered area of the first coat layer corresponds to the first coat layer exposure rate. A number average value for 10 carrier particles included in a measurement target (one of the carriers CA-1 to CA-10 and CB-1 to CB-3) was taken to be an evaluation value (first coat layer exposure rate) for the measurement target.

In each of the carriers CA-1 to CA-10 and CB-1 to CB-3, the first coat layer covered at least 85% and no greater than 98% of the surface region of the carrier core. In each of the carriers CA-1 to CA-10 and CB-1 to CB-3, the second coat layer completely covered a region of the surface region of the carrier core that was exposed through the first coat layer, and was present also on the first coat layer.

[Production of Carrier CB-4]

A single coat layer was formed on each carrier core in production of the carrier CB-4.

(Single Coat Layer Formation)

Methyl silicone resin in an amount of 100 g in terms of a solid content was dissolved in 500 mL of toluene to give a coating liquid. The carrier cores (particles) prepared according to the procedure described above were loaded into a flow coating machine ("Multiplex MP-01", product of Powrex Corporation), and fluidized therein. The coating liquid including 10 parts by mass of methyl silicone resin relative to 100 parts by mass of the carrier cores was applied by spray-coating to the fluidized carrier cores using the flow coating machine. Subsequently, thermal treatment at a temperature of 270° C. was performed on a fluidized bed in the flow coating machine for 2 hours to harden the coating liquid. Through the above, a carrier (carrier CB-4) including a number of carrier particles was produced.

[Evaluation Method]

Samples (carriers CA-1 to CA-10 and CB-1 to CB-4) were evaluated as described below.

(Preparation of Two-Component Developer)

A two-component developer was prepared by mixing 100 parts by mass of a carrier (evaluation target: one of the carriers CA-1 to CA-10 and CB-1 to CB-4) and 8 parts by mass of the toner (positively chargeable toner produced according to the procedure as described above) for 30 minutes using a powder mixer ("ROCKING MIXER (registered Japanese trademark)", product of AICHI ELECTRIC CO., LTD., mixing method: container rocking and rotating).

(Charging Ability of Carrier)

An evaluation apparatus used was a printer ("FS-C5250DN", product of KYOCERA Document Solutions Inc., photosensitive drum: organic photosensitive drum including a single-layer photosensitive layer, charger: contact charging roller, photosensitive member cleaning method: method using a cleaning blade). The two-component developer prepared according to the method as described above was loaded into a development device of the evaluation apparatus, and a toner for replenishment use (the positively chargeable toner produced according to the procedure as described above) was loaded into a toner container of the evaluation apparatus.

A first printing durability test was performed in an environment at a temperature of 25° C. and a relative humidity of 65% using the evaluation apparatus. The first printing durability test was continuous printing of a sample image having a printing rate of 4% on 10,000 sheets of a recording medium (printing paper). After the first printing durability test, the development device was taken out of the evaluation apparatus. Further, the two-component developer was taken out of the development device. Then, an amount of charge of toner included in the two-component developer (also referred to below as an amount of charge $Q_A$) was measured. A Q/m meter ("MODEL 210HS", product of TREK, INC.) was used to measure the amount of charge $Q_A$. After the measurement of the amount of charge $Q_A$, the taken-out development device was re-fitted into the evaluation apparatus. Then, a second printing durability test was performed in an environment at a temperature of 25° C. and a relative humidity of 65% using the evaluation apparatus. The second printing durability test was continuous printing of a sample image having a printing rate of 4% on 90,000 sheets of a recording medium (printing paper). After the second printing durability test, the development device was taken out of the evaluation apparatus. Further, the two-component developer was taken out of the development device. Then, an amount of charge of toner included in the two-component developer (also referred to below as an amount of charge $Q_B$) was measured. A Q/m meter ("MODEL 210HS", product of TREK, INC.) was used to measure the amount of charge $Q_B$. A charge variation rate as expressed by the following expression was then calculated.

$$\text{Charge variation rate}=100\times|(\text{an amount of charge } Q_A)-(\text{an amount of charge } Q_B)|/Q_A$$

Initial charging ability of the toner was evaluated as good when the amount of charge $Q_A$ was at least 20 μC/g and no greater than 40 μC/g and evaluated as poor when the amount of charge $Q_A$ was less than 20 μC/g or greater than 40 μC/g.

Charge durability of the toner was evaluated as good when the charge variation rate was no greater than 20% and evaluated as poor when the charge variation rate was greater than 20%.

[Evaluation Results]

Table 2 shows results of evaluation of initial charging ability (amount of charge $Q_A$) and charge durability (charge variation rate) for each of the carriers CA-1 to CA-10 and CB-1 to CB-4.

TABLE 2

| | | Charging ability | |
|---|---|---|---|
| | Carrier | Initial [μC/g] | Durability [%] |
| Example 1 | CA-1 | 32 | 7 |
| Example 2 | CA-2 | 31 | 9 |
| Example 3 | CA-3 | 33 | 5 |
| Example 4 | CA-4 | 29 | 8 |
| Example 5 | CA-5 | 37 | 8 |
| Example 6 | CA-6 | 34 | 11 |
| Example 7 | CA-7 | 27 | 6 |
| Example 8 | CA-8 | 25 | 8 |
| Example 9 | CA-9 | 21 | 4 |
| Example 10 | CA-10 | 40 | 19 |
| Comparative Example 1 | CB-1 | 28 | 32 (poor) |
| Comparative Example 2 | CB-2 | 33 | 27 (poor) |
| Comparative Example 3 | CB-3 | 44 (poor) | 27 (poor) |
| Comparative Example 4 | CB-4 | 16 (poor) | 3 |

Each of the carriers CA-1 to CA-10 (carriers according to Examples 1 to 10) had the aforementioned basic features. Specifically, each of the carriers CA-1 to CA-10 included a plurality of carrier particles each including a carrier core, a first coat layer, and a second coat layer. The first and second coat layers covered a surface of the carrier core. The first and second coat layers gave a layered structure in which the first coat layer and the second coat layer were layered in order from the surface of the carrier core. The first coat layer contained a fluororesin. The second coat layer contained a silicone resin and a fluorine silane in an amount of at least 1.0% by mass relative to a mass of the silicone resin (see "Fluorine silane" in Table 1). An area $S_A$ of a region of a surface region of the first coat layer that was covered with the second coat layer and an area $S_B$ of a region of the surface region of the first coat layer that was not covered with the second coat layer satisfied a relationship represented by "$0.05\leq S_B/(S_A+S_B)\leq 0.50$" (see "Exposure rate" in Table 1).

For example, in each of the carriers CA-1 to CA-4, the amount of the fluororesin in the first coat layer relative to a total mass of the fluororesin in the first coat layer and the silicone resin in the second coat layer was 40% by mass (=100×0.8/(0.8+1.2)) (see Table 1).

Also, in each of the carriers CA-5 and CA-6, the amount of the fluororesin in the first coat layer relative to a total mass of the fluororesin in the first coat layer and the silicone resin in the second coat layer was 60% by mass (=100×1.2/(1.2+0.8)) (see Table 1).

Furthermore, in each of the carriers CA-7 and CA-8, the amount of the fluororesin in the first coat layer relative to a total mass of the fluororesin in the first coat layer and the silicone resin in the second coat layer was 20% by mass (=100×0.4/(0.4+1.6)) (see Table 1).

In the carrier CA-9, the amount of the fluororesin in the first coat layer relative to a total mass of the fluororesin in the first coat layer and the silicone resin in the second coat layer was 10% by mass (=100×0.2/(0.2+1.8)) (see Table 1).

In the carrier CA-10, the amount of the fluororesin in the first coat layer relative to a total mass of the fluororesin in the first coat layer and the silicone resin in the second coat layer was 70% by mass (=100×1.4/(1.4+0.6)) (see Table 1).

As shown in Table 2, the carriers CA-1 to CA-10 each had sufficient charging ability both in the initial stage of printing and after continuous printing.

What is claimed is:

1. An electrostatic latent image developing carrier comprising a plurality of carrier particles each including a carrier core, a first coat layer, and a second coat layer, the first and second coat layers covering a surface of the carrier core, wherein the first and second coat layers give a layered structure in which the first coat layer and the second coat layer are layered in order from the surface of the carrier core, the first coat layer contains a fluororesin, the second coat layer contains a silicone resin and a fluorine silane in an amount of at least 1% by mass relative to a mass of the silicone resin, and an area $S_A$ and an area $S_B$ satisfy a relationship represented by "$0.05\leq S_B/(S_A+S_B)\leq 0.50$", the area $S_A$ being an area of a region of a surface region of the first coat layer that is covered with the second coat layer, the area $S_B$ being an area of a region of the surface region of the first coat layer that is not covered with the second coat layer.

2. The electrostatic latent image developing carrier according to claim 1, wherein the carrier core is a ferrite particle, the first coat layer covers at least 85% and no greater than 98% of a surface region of the carrier core, and the second coat layer completely covers a region of the surface region of the carrier core that is exposed through the first coat layer, the second coat layer being present also on the first coat layer.

3. The electrostatic latent image developing carrier according to claim 2, wherein the first coat layer has a thickness of at least 100 nm and no greater than 450 nm, and the second coat layer has a thickness of at least 100 nm and no greater than 550 nm.

4. The electrostatic latent image developing carrier according to claim 1, wherein an amount of the fluorine silane in the second coat layer is at least 5% by mass and no greater than 50% by mass relative to the mass of the silicone resin, an amount of the fluororesin in the first coat layer is at least 40% by mass and no greater than 60% by mass relative to a total mass of the fluororesin in the first coat layer and the silicone resin in the second coat layer, and the area $S_A$ and the area $S_B$ satisfy a relationship represented by "$0.25\leq S_B/(S_A+S_B)\leq 0.40$".

5. The electrostatic latent image developing carrier according to claim 1, wherein an amount of the fluorine silane in the second coat layer is at least 5% by mass and no greater than 50% by mass relative to the mass of the silicone resin, an amount of the fluororesin in the first coat layer is at least 10% by mass and no greater than 20% by mass relative to a total mass of the fluororesin in the first coat layer and the silicone resin in the second coat layer, and the area $S_A$ and the area $S_B$ satisfy a relationship represented by "$0.05 \leq S_B/(S_A+S_B) \leq 0.15$".

6. The electrostatic latent image developing carrier according to claim 1, wherein an amount of the fluorine silane in the second coat layer is at least 25% by mass and no greater than 35% by mass relative to the mass of the silicone resin.

7. The electrostatic latent image developing carrier according to claim 1, wherein the fluorine silane is trimethoxy(3,3,3-trifluoropropyl) silane.

8. A two-component developer comprising:

the electrostatic latent image developing carrier according to claim 1; and a positively chargeable toner capable of being positively charged by friction against the electrostatic latent image developing carrier.

9. The two-component developer according to claim 8, wherein the positively chargeable toner includes a plurality of toner particles each including a toner mother particle and an external additive attached to a surface of the toner mother particle, and the external additive includes positively chargeable silica particles.

* * * * *